US008349263B2

(12) United States Patent
Panditrao

(10) Patent No.: US 8,349,263 B2
(45) Date of Patent: Jan. 8, 2013

(54) HIGH ENERGY REDUCTION IN A PROPANE DEHYDROGENATION UNIT BY UTILIZING A HIGH PRESSURE PRODUCT SPLITTER COLUMN

(75) Inventor: Sunil Panditrao, Hackettstown, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 13/226,083

(22) Filed: Sep. 6, 2011

(65) Prior Publication Data

US 2012/0014846 A1 Jan. 19, 2012

Related U.S. Application Data

(63) Continuation of application No. 12/183,034, filed on Jul. 30, 2008, now Pat. No. 8,013,201.

(51) Int. Cl.

| | |
|---|---|
| ***B01J 19/00*** | (2006.01) |
| *B01J 8/00* | (2006.01) |
| *C07C 5/00* | (2006.01) |
| *C07C 2/00* | (2006.01) |
| *C07C 5/327* | (2006.01) |

(52) U.S. Cl. ..... 422/129; 422/187; 585/250; 585/251; 585/500; 585/654

(58) Field of Classification Search ..... 422/129, 422/187; 585/250–252, 500, 654, 800, 802, 585/809, 910

See application file for complete search history.

(56) References Cited

U.S. PATENT DOCUMENTS

| | | | | |
|---|---|---|---|---|
| 3,968,030 | A | 7/1976 | Cros | |
| 4,121,917 | A * | 10/1978 | Baker et al. | 62/630 |
| 4,749,820 | A | 6/1988 | Kuo et al. | |
| 4,753,667 | A | 6/1988 | O'Connell et al. | |
| 5,720,929 | A | 2/1998 | Minkkinen et al. | |
| 6,218,589 | B1 * | 4/2001 | Cottrell | 585/324 |
| 2003/0029190 | A1 | 2/2003 | Trebble | |

OTHER PUBLICATIONS

International Search Report for PCT/US2009/048284 mailed Aug. 7, 2009.

International Preliminary Report on Patentability for PCT/US2009/048284 mailed Feb. 10, 2011.

* cited by examiner

*Primary Examiner* — Walter D Griffin
*Assistant Examiner* — Natasha Young
(74) *Attorney, Agent, or Firm* — Alix, Yale & Ristas, LLP

(57) ABSTRACT

An improved process for the production of olefins, and in particular for separation of olefins produced by a dehydrogenation process from paraffin feed stocks, is provided. A high pressure product splitter is used to separate olefins produced in a dehydrogenation plant from residual paraffin feed stocks. The use of a high pressure splitter to separate olefin products from paraffin feed stocks allows for recovery of a high purity olefin product with lower energy consumption compared to prior art processes. The process is particularly suited to separation of propylene from propane.

5 Claims, 3 Drawing Sheets

HIGH ENERGY REDUCTION IN A PROPANE DEHYDROGENATION UNIT BY UTILIZING A HIGH PRESSURE PRODUCT SPLITTER COLUMN

CROSS REFERENCE TO RELATED APPLICATION

The present application is a continuation of U.S. patent application Ser. No. 12/183,034, filed Jul. 30, 2008, the content of which is incorporated herein by reference in its entirety.

FIELD OF THE INVENTION

The present invention relates to an improved process for the production of olefins, and in particular for separation of olefins produced by a dehydrogenation process from paraffin feed stocks. The process is particularly suited to separation of propylene from propane. In this embodiment, a high pressure product splitter is used to separate propylene from residual propane produced in a dehydrogenation plant. The use of a high pressure splitter to separate propylene from propane provides a process for recovery of a high purity propylene product with lower energy consumption compared to prior art processes.

BACKGROUND OF THE INVENTION

Olefin hydrocarbons are useful for the production of a number of petrochemical products, such as polymers, motor fuel blending additives, and other products. Short chain saturated hydrocarbons having from 2 to 5 carbon atoms per molecule are often subjected to dehydrogenation to form the corresponding olefin. The olefins, in turn, may be used in the alkylation of isoparaffins, in the etherification of alcohols to make motor fuel blending additives, or as monomers used to produce various polymer materials.

One particularly useful olefin is propylene, which is produced by dehydrogenation of propane. Propylene is the world's second largest petrochemical commodity and is used in the production of polypropylene, acrylonitrile, acrylic acid, acrolein, propylene oxide and glycols, plasticizer oxo alcohols, cumene, isopropyl alcohol and acetone. The growth in propylene production is primarily driven by the industry demand for polypropylene, which is used in such everyday products as packaging materials and outdoor clothing.

Propylene is primarily produced from the dehydrogenation of propane. A conventional propane dehydrogenation process involves the following steps: dehydrogenation of propane to propylene in a reactor, compression of the reactor effluent, and recovery and purification of the propylene product. FIG. 1 shows the steps in a conventional dehydrogenation process. In the dehydrogenation step (1), the conversion of propane to propylene is typically carried out over a catalyst. The effluent from the dehydrogenation unit is compressed in a compressor (2) to a sufficiently high pressure, typically 150 psig or greater, to recover unreacted propane and propylene from lighter components in a recovery section.

In the recovery step (3), the compressed reactor effluent is successively chilled with refrigeration to maximize the recovery of propane and propylene for further purification. The offgas from this process mainly consists of hydrogen, methane, ethane and ethylene. The hydrocarbons from the recovery step (3) are then subjected to distillation in the purification step (4). In a first distillation column, a deethanizer, ethane and lighter gases are recovered as overhead offgas, and propane and propylene are recovered in the deethanizer bottoms stream. In a second distillation column, generally referred to as a product splitter, propylene product is recovered as overhead and propane from the bottoms is recycled back to the dehydrogenation step. A purge stream of fresh propane and recycled propane are distilled to remove heavier components from the process. During purification, the product splitter is typically reboiled by using an external heat source (e.g. heat pump) whereby the overhead vapor is compressed and used as the reboiling medium.

One common process for production of propylene by dehydrogenation of propane is known as the CATOFIN process. In the CATOFIN process, propane is converted to propylene by feeding propane to a dehydrogenation reactor containing a fixed bed Chromium-Alumina catalyst. There are typically multiple dehydrogenation reactors operating in parallel to allow catalyst regeneration to occur in some reactors while others are in operation. The dehydrogenation reactors are typically maintained at about 600-650° C.

The effluent from the dehydrogenation reactors is cooled and compressed using a steam driven product compressor. The compressed product is sent to a recovery section where inert gases, hydrogen and light hydrocarbons are removed from the compressed reactor effluent. The propylene rich gas from the recovery unit is then sent to the product purification section where propylene is separated from propane as described above.

The purification step of a conventional propane dehydrogenation process is shown in FIG. 2. The product splitter (110) in the conventional process is fed the heavy end from a deethanizer which contains $C_{3+}$ compounds through feed line (100). This feed is distilled in the product splitter such that the propylene product is recovered in the overhead stream (102) and the majority of the remaining compounds, including unreacted propane, exit in the bottoms stream (128). This conventional product splitter is operated at pressures of about 80-100 psig and temperatures of 40-60° F.

The overhead propylene vapor stream (102) is combined with the overhead (105) from separator (150) and sent to heat pump (130) through line (106). The heat pump is driven by steam turbine (131) using high pressure steam provided through line (133). The exhaust steam is discharged through line (122) to condenser (160), where it is cooled and discharged from the plant.

The overhead vapor stream (102) is compressed in heat pump (130) and flows through discharge line (108) to provide heat to product splitter reboiler (120). The warmed propylene is split, with a portion flowing back to the product splitter through line (114), and the remainder flowing through line (112) to product separator (150). The overhead (105) from the separator (150) is combined with the overhead propylene stream (102) from the product splitter and fed to the heat pump (130) as described above. The propylene product (118) from the bottoms of the separator is sent to other units for further processing.

The product compression machine is driven by steam turbine (141) which is fed high pressure steam through line (143). The product compressor is fed the product from the dehydrogenation reactor (not shown) through line (127) for compression. The compressed dehydrogenation product is fed through line (126) for separation in a deethanizer. In conventional plants, the exhaust steam from the steam turbine (141) is discharged through line (124) to condenser (170), where it is cooled and discharged from the plant.

The bottoms of the conventional low pressure product splitter comprises mainly propane. The bottoms are discharged through line (128) and split, with a portion of the bottoms recycled through line (104) to reboiler (120), where it is heated and sent back to the product splitter (110). The remainder of the bottoms are discharged through line (116) and sent back to the dehydrogenation reactors.

This conventional dehydrogenation process has some inherent limitations. One primary limitation is the amount of input energy required to produce the propylene product. Currently, the total energy consumption for the conventional dehydrogenation process, for example, is about 100 kcal/kg of propylene product. As such, there exists an ongoing and unmet need in the industry for a less expensive and more efficient method for dehydrogenation of propane.

SUMMARY OF THE INVENTION

The present invention relates to improved processes for separating olefins produced in dehydrogenation reactors from residual paraffin feed stocks. The process may be used, for example, for separating propylene from propane following a dehydrogenation process to produce propylene from propane. The high pressure product splitter has a reboiler that utilizes heat supplied from the exhaust steam from the steam turbines driving a dehydrogenation reactor product compressor and a refrigeration compressor. Use of this exhaust steam allows the product splitter to be operated at higher pressures than in conventional dehydrogenation systems The feed stream to the high pressure product splitter may be provided from any type of plant that converts a paraffin to an olefin, such as propane to propylene, and utilizes a separation stage to separate unreacted paraffin from the olefin product. In one embodiment, propylene may be produced for the process of the present invention using any type of dehydrogenation process to convert propane to propylene, such as for example the CATOFIN process. In a preferred embodiment, the product stream from the dehydrogenation unit is further treated, such as by compression and refrigeration, to remove inert gases, hydrogen and light hydrocarbons. A steam driven compressor is used to compress the product stream from the dehydrogenation reactor. The product stream is preferably fed to a deethanizer column, in which $C_2$ and lighter components are removed in an overhead stream, while the bottoms stream is composed of propane and propylene with a small quantity of other impurities. In this embodiment, the deethanizer bottoms stream is fed to the high pressure product splitter stage of the present invention.

In one embodiment of the invention, the product purification stage generally comprises the high pressure product splitter column, a steam turbine driven refrigeration compressor, a steam turbine driven dehydrogenation reactor product compressor, and at least one reboiler operably connected to the product splitter column. A feed stream from a dehydrogenation plant, such as the bottoms from a deethanizer unit used in a propane to propylene dehydrogenation unit, is fed to the high pressure product splitter. The high pressure product splitter preferably operates at a pressure of between about 200 psig and 375 psig, and at a temperature of about 80° F. to 160° F. The overhead stream from the product splitter column is split, with a portion of the overhead stream returned to the product splitter as a reflux stream and the remainder comprising a product stream which is sent to storage or to another unit for further processing.

A steam turbine driven refrigeration compressor is used to provide heat to the process by heat exchange with a portion of the bottoms from the product splitter. Exhaust steam from the steam turbines used to drive the refrigeration compressor and the dehydrogenation reactor product compressor is fed to a reboiler to provide process heat used to separate the products in the product splitter column. In some embodiments of the invention, the exhaust steam streams are combined before being fed to the reboiler.

In another embodiment of the invention, the overhead product stream from the product splitter is separated into an overhead product stream and a reflux stream that is fed back to the splitter column. The product stream is sent to other units for additional processing. In yet another embodiment of the process of the invention, the overhead product stream is cooled in a condenser before it is split to form a reflux stream and a product stream.

The bottoms stream from the product splitter may be split into a recycle stream and a bottoms return stream. In one embodiment of the process, the recycle stream is fed to at least one reboiler where it is heated by exhaust steam from the steam turbines driving the refrigeration compressor and the product compressor.

In another embodiment of the invention, the bottoms return stream is split into a first return stream and a second return stream. The first return stream is fed to a first reboiler where it is heated by exhaust steam from the steam turbines driving the refrigeration compressor and the product compressor. The second return stream is fed to a second reboiler where it is heated by the output product stream from the refrigeration compressor.

The separation process described may be used in any olefin conversion process to separate an olefin from a feed stock such as a paraffin. The process of the present invention is particularly advantageous for processes that require a considerable amount of power provided by a steam turbine or that requires energy intensive separation because the products have a small differential in boiling temperature.

The processes of the present invention are particularly useful for separation of propylene from propane. One advantage of the present invention is that the inclusion of a high pressure product splitter using low pressure steam heat reduces the energy requirement to produce propylene as compared to other dehydrogenation processes. This advantage is given by way of non-limiting example only, and additional benefits and advantages will be readily apparent to those skilled in the art in view of the description set forth herein. For example, total energy consumption using the product purification scheme of the present invention may reduce the total energy consumption by as much as 10-15% as compared to conventional CATOFIN units. Other advantages of the processes of the invention will be apparent to those skilled in the art based upon the following detailed description of preferred embodiments. The limitation of the detailed description of the present invention to the dehydrogenation of propane to form propylene is merely illustrative of the general principles involved as well as being a practical example of an industrial use of the invention. It should be understood, however, that description of such an embodiment for the particular named components and the equipment arrangement specified is not intended as limiting the invention in any way.

BRIEF DESCRIPTION OF THE DRAWINGS

This invention is best understood from the following detailed description when read in connection with the accompanying drawings.

DETAILED DESCRIPTION OF THE INVENTION

The present invention relates to improved processes for energy intensive separations, such as in the production of propylene from propane. In the processes of the present invention, feed from a process for conversion of paraffins to olefins, such as the bottoms from a deethanizer column, is split and fed to a high pressure splitter column to separate the olefin product from the paraffin feed stock.

The following description of preferred embodiments of the present invention are provided as exemplary only, and are not intended to limit the full scope of the invention described and claimed herein in any way. It should be understood that the processes described below may be used in any olefin conversion process to separate an olefin from a feed stock such as a paraffin. In particular, the process may be used for separations that require a considerable amount of power provided by a steam turbine or that requires energy intensive separation because the products have a small differential in boiling temperature.

One embodiment of the present invention relates to a use of a high pressure product splitter in a propane dehydrogenation system for the production of propylene from propane. The present invention uses increased pressure inside the product splitter and steam recovered or supplied from other equipment for reboiling, eliminating the need for an external heat source. The total energy consumption for a dehydrogenation process in a CATOFIN® unit using a high pressure product splitter in accordance with the present invention, for example, is about 85-90 kcal/kg of propylene product, a reduction of about 10-15% total energy per kg of product.

Figure 1:
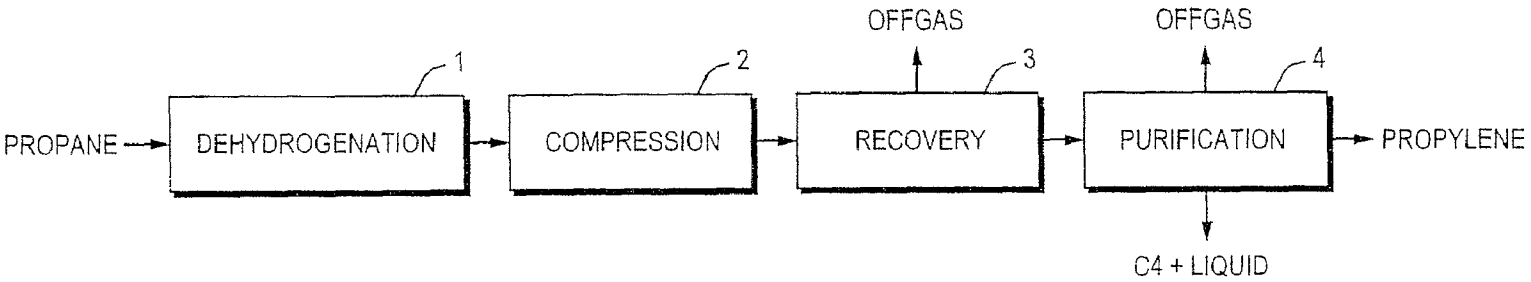
FIG. 1 (PRIOR ART)
FIG. 1 shows the steps of a typical prior art propane dehydrogenation processing scheme.
Figure 2:
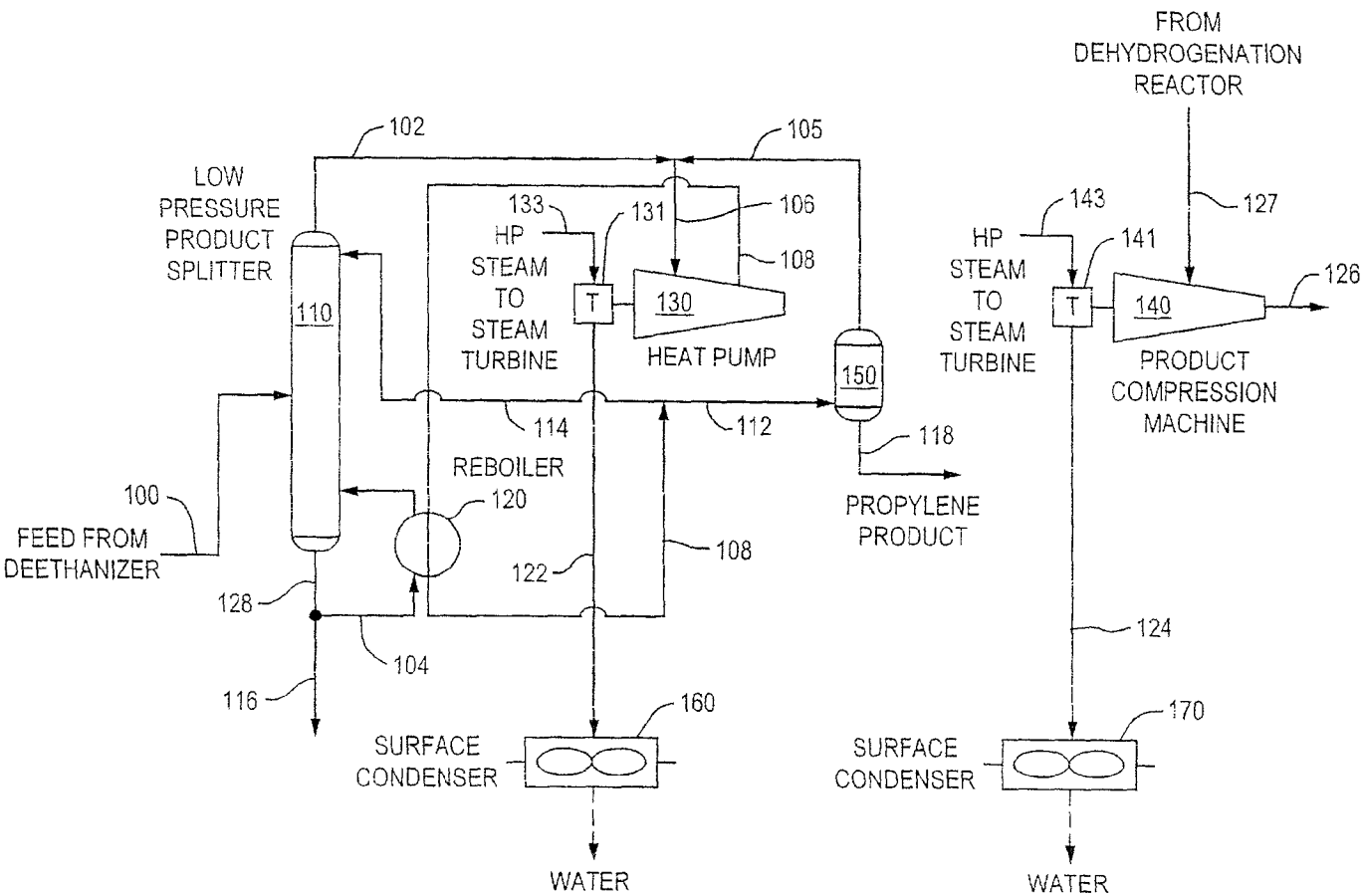
FIG. 2 (PRIOR ART)
FIG. 2 is a schematic drawing of a conventional prior art processing scheme for separation of an olefin product from a paraffin feedstock.
Figure 3:
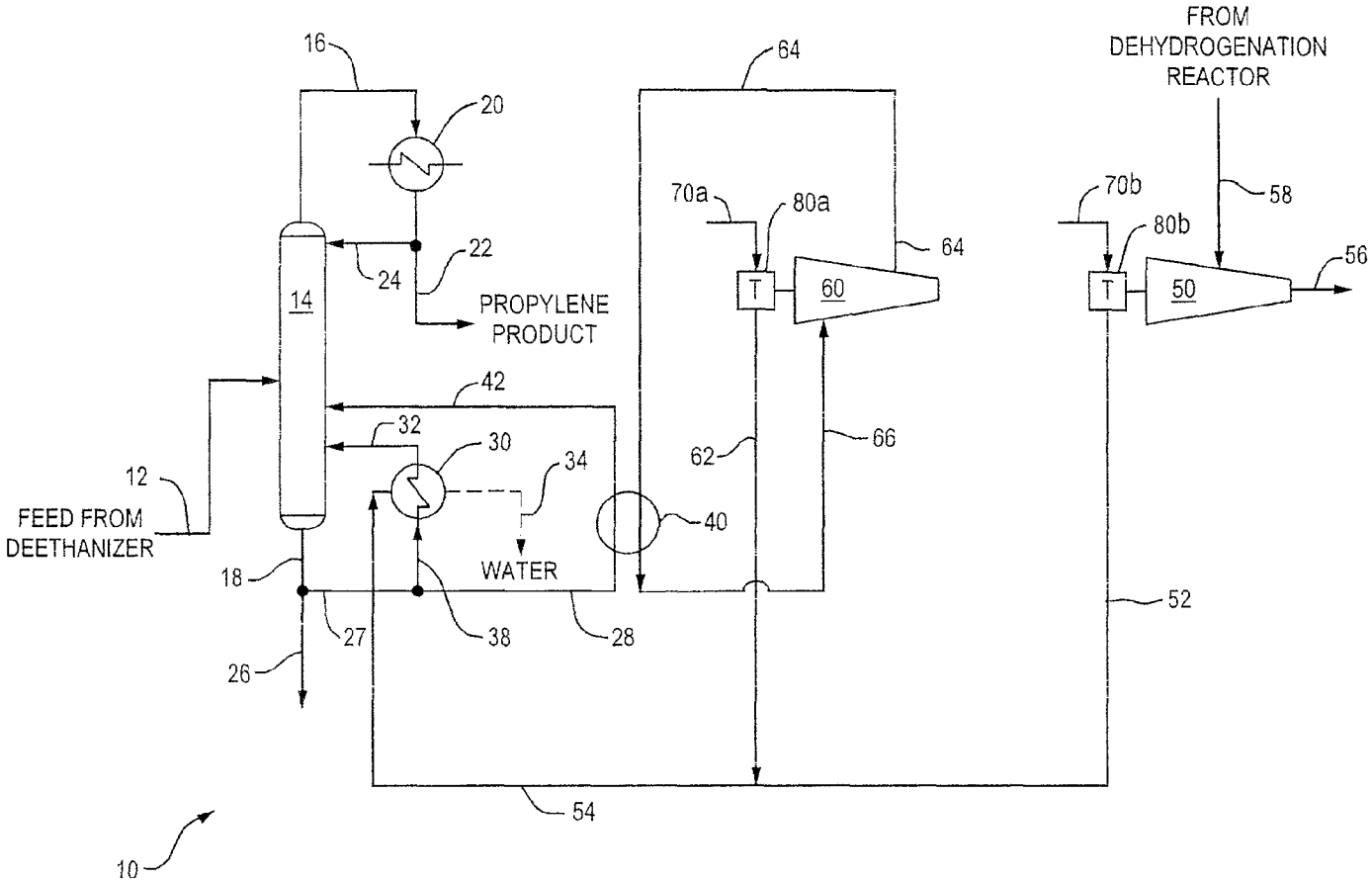
FIG. 3 is a schematic drawing of one embodiment of the improved hydrogenation process of the present invention.

An example purification system (10) to be used after a dehydrogenation system (not shown) of the present invention is shown in FIG. 3. In one embodiment of the processes of the present invention described in detail below, propane is fed to any type of conventional dehydrogenation reactor to produce propylene. The dehydrogenation reactor product stream (58) is compressed in compressor (50) and sent to a recovery unit through line (56) to maximize recovery of propane and propylene. The compressed dehydrogenation reactor product stream is sent to a deethanizer column where $C_2$ and lighter components are removed as overhead vapors and $C_{3+}$ components are contained in the bottoms. In a preferred embodiment, the dehydrogenation units are CATOFIN type reactors.

The product splitter (14) may be fed the bottoms (12) from the deethanizer column (not shown). The bottoms from the deethanizer column contain $C_{3+}$ compounds, including propylene and propane. The product splitter (14) is operated at a pressure higher than the pressure used in prior conventional purification systems. In one embodiment, the product splitter is operated at a pressure of between about 200 psig and 375 psig, and at a temperature of about 80° F. to 160° F. In a preferred embodiment, the product splitter is operated at a pressure of about 330 psig, and at a temperature of about 130° F. The high pressure product splitter is a distillation column of a typical design used for separation of olefins from paraffins, such as in the separation of propane and propylene, and designed to operate at the pressures used in the processes of the present invention.

The feed (12) is distilled in the product splitter (14) such that the propylene product is recovered in the overhead stream (16) and the majority of the remaining compounds, including propane, exit in the bottoms stream (18). In some embodiments, the overhead stream (16) from the product splitter (14) may be fed to a cooling water condenser (20) to reduce the temperature of the overheads and to convert the overhead vapors to liquid. Preferably, the overhead stream is cooled from a temperature of between 50° F. to 130° F. to a cooler temperature of between 48° F. to 128° F. If desired, the overhead stream may be split with a portion being sent back to the product splitter through line (24) as reflux, and the remaining overhead stream (22) containing the propylene product being sent to storage or for further processing in other units.

A closed loop is provided to provide additional heat to the process through heat exchanger (40). A potion of the bottoms from the product splitter flows through line (28) to heat exchanger (40), where the bottoms stream is heated by making heat exchange contact with a compressed refrigerant fed to the heat exchanger through line (64). The heated bottoms stream exiting the heat exchanger (40) is fed back to the product splitter through line (42).

The compressed refrigerant fed to heat exchanger (40) exits the heat exchanger through line (66) and is fed to refrigeration compressor (60). The compressed refrigerant may be used in other parts of the process before condensing in heat exchanger (40). The compressed fluid exits the refrigeration compressor through line (64), In one embodiment, the refrigerant is compressed to a pressure of between about 250 psig and 375 psig at a temperature of between about 105° F. and 150° F. in the refrigeration compressor, and exits the heat exchanger (40) a pressure of between about 240 psig and 365 psig at a temperature of between about 105° F. and 150° F.

The refrigeration compressor is driven by a steam turbine (80*a*) driven using high pressure steam supplied through line (70*a*). In one embodiment, the high pressure steam is supplied at a pressure of between about 580 psig and 660 psig. The exhaust steam from the steam turbine (80*a*) is discharged through line (62) and used to provide heat to reboiler (30) as described further below.

The dehydrogenation reactor product compressor (50) is driven by steam turbine (80*b*), which is supplied high pressure steam through steam line (70*b*). The exhaust steam from steam turbine (80*b*) exits through line (52), and used to provide heat in reboiler (30) as described below.

The splitter bottoms, containing primarily propane, exit the product splitter (14) through bottoms stream (18). The bottoms stream is split into a return stream (27) and a recycle stream (26), which exits the plant through line (26) for further processing, such as by recycling to the dehydrogenation unit. The return stream is split into a first return stream (38) and a second return stream (28). The first return stream is fed through line (38) to reboiler (30) and fed back into the product splitter (14) through line (32). Preferably, the first return stream is heated in reboiler (30) to a temperature of between 100° F. and 160° F. Heat energy in the form of steam is fed to the reboiler (30) from exhaust steam stream (62) taken from steam turbine (70*a*) and from a exhaust steam stream (52) taken from steam turbine (80*b*). If desired, the two streams (62) and (52) may be combined to form a single steam line (54).

The second return stream (28) is fed to heat exchanger (40) and fed back to the product splitter (14) through line (42) after being heated in the heat exchanger. Heat is provided to reboiler (40) by the compressed refrigerant line (64) as described above.

The operation of the high pressure product splitter (14) in the present invention differs from a conventional system in at least the following ways. The product splitter (14) of the present invention is operated at higher pressures as a result of capturing the heat energy from the steam turbine exhausts. For example, in a conventional propane dehydrogenation the product splitter is operated at pressures between 65 psig to 175 psig and temperatures between 50° F. and 150° F.

In the conventional scheme, heat for reboiling is supplied using an external source, such as a heat pump, and the steam and/or condensed water from the steam used to drive the steam turbines for the heat pump (or a refrigeration compressor) and the product compressor is discharged. In one embodiment of the present invention, the heat energy is supplied to the heat exchanger(s) for reboiling using a low level steam from the exhaust of the steam turbines. By capturing this energy, the product splitter may be operated at higher pressure without the need for additional energy input. This allows a high yield of purified propylene to be obtained with lower energy input than in conventional systems.

While preferred embodiments have been shown and described, various modifications may be made to the processes described above without departing from the spirit and scope of the invention. For example, the process described above may be used in any olefin conversion process that requires a considerable amount of power provided by a steam turbine or requires energy intensive separation because the products have a small temperature differential. Accordingly, it is to be understood that the present invention has been described by way of example and not by limitation.

What is claimed is:

1. A system for producing propylene, comprising:

a dehydrogenation reactor that converts propane in a feed stream to propylene, producing a dehydrogenation reactor effluent, a compressor that compresses the dehydrogenation reactor effluent to form a compressor effluent stream, a first turbine driving the compressor, the first turbine having a steam inlet, and a steam outlet containing a first steam effluent stream, a deethanizer that receives the compressor effluent stream, removes ethane, ethylene and lighter components in a top outlet, and removes C3+ components in a deeethanizer bottoms stream through a bottom outlet, a high pressure product splitter that receives the deethanizer bottoms stream as an inlet stream, removes a propylene stream through a top outlet, and removes a propane stream through a bottom outlet, the product splitter operating at a pressure of between about 200 psig and 375 psig, and a temperature of about 80° F. to 160° F., and a first splitter reboiler that reheats a first portion of the propane stream before the first portion is returned to the product splitter, the first splitter reboiler having a steam inlet that receives the first steam effluent stream from the first turbine as the first reboiler steam inlet stream.

2. The separation system of claim 1, further comprising a second splitter reboiler in which a second portion of the propane stream is reheated before the second portion is returned to the product splitter.

3. The separation system of claim 2, wherein the second portion of the propane stream is heated using a compressed refrigerant stream from a refrigeration compressor.

4. The separation system of claim 1, wherein the refrigeration compressor is driven by a second turbine.

5. The separation system of claim 4, wherein the first reboiler steam inlet stream further comprises a second steam effluent stream from the second turbine.

* * * * *

UNITED STATES PATENT AND TRADEMARK OFFICE

CERTIFICATE OF CORRECTION

PATENT NO. : 8,349,263 B2
APPLICATION NO. : 13/226083
DATED : January 8, 2013
INVENTOR(S) : Sunil Panditrao It is certified that error appears in the above-identified patent and that said Letters Patent is hereby corrected as shown below:

In the Claims

Claim 1, column 8, line 6, delete “deeethanizer” and insert --deethanizer--.

Signed and Sealed this
Twenty-fourth Day of September, 2013

Teresa Stanek Rea
*Deputy Director of the United States Patent and Trademark Office*